United States Patent [19]

Taguchi et al.

[11] Patent Number: 4,741,075

[45] Date of Patent: May 3, 1988

[54] COMPOSITE SHEET AND METHOD OF PRODUCING SAME

[75] Inventors: Setsuo Taguchi; Hiroki Fukunaga, both of Otsu; Mineto Fushida, Moriyama, all of Japan

[73] Assignee: Toray Industries, Inc., Tokyo, Japan

[21] Appl. No.: 755,072

[22] Filed: Jul. 15, 1985

[30] Foreign Application Priority Data

Jul. 23, 1984 [JP] Japan ..... 59-151337
Jul. 25, 1984 [JP] Japan ..... 59-153108
Oct. 18, 1984 [JP] Japan ..... 59-219098

[51] Int. Cl.[4] ..... D04H 1/46

[52] U.S. Cl. ..... 28/104; 26/1; 156/344; 241/4; 428/288; 428/904

[58] Field of Search ..... 156/344; 28/104; 428/91, 288, 283, 297, 300, 151, 904, 360, 361; 26/1; 241/4

[56] References Cited

U.S. PATENT DOCUMENTS 2,972,554 2/1961 Muskat et al. ..... 428/361
3,329,556 7/1967 McFalb et al. ..... 26/1
3,406,033 10/1968 Reitz ..... 26/1
3,408,709 11/1968 Reitz ..... 26/1
3,932,687 1/1976 Okamoto et al. ..... 428/294
4,329,763 5/1982 Alexander et al. ..... 28/104

*Primary Examiner*—James J. Bell
*Attorney, Agent, or Firm*—Austin R. Miller

[57] ABSTRACT

A composite sheet comprising a fiber base and a binder, wherein said binder is broken into small fragments which adhere to the fibers, but at least some not to each other.

Said composite sheet is produced by a method comprising the step of (a) applying a binder to a fiber base and (b) directing a fluid jet stream to the fiber base during or after coagulation of the binder applied thereto.

The composite sheet of this invention is very soft and has considerable strength, because the fluid jet breaks weak portions of the binder only to divide the binder into small fragments, without breaking the tougher portions of the binder which mainly contribute to the strength of the leather.

8 Claims, 7 Drawing Sheets

DRAPE COEFFICIENT VS. FLUID PRESSURE

AMOUNT OF FRAGMENTARY BINDER (LESS THAN 30 MESH) VS. FLUID PRESSURE

ABRASION RESISTANCE VS. DRAPE COEFFICIENT

COMPOSITE SHEET AND METHOD OF PRODUCING SAME

BACKGROUND OF THE INVENTION

1. Field of the Invention

The present invention relates to a soft composite sheet and a method of producing it.

Many attempts have been made to obtain soft and dense artificial leather like that of natural leather.

Conventionally, these products comprise a base fiber structure and a binder. Attempts to improve the base fiber structure include the use of non-woven sheet, woven sheet, knitted sheet, and woven or knitted sheet integrated with short fiber web. On the other hand, super-fine fibers have been used as fibers which constitute base fiber sheet. Also the choice of binder for the synthetic leather, such as polyurethane, has been improved. But it has been extremely difficult to increase softness and drapability without significantly decreasing strength and abrasion resistance.

2. Description of the Prior Art

For example, U.S. Pat. No. 3,544,357 discloses softening methods involving adding a softening agent or a blowing agent to a binder prior to impregnation. Japanese Patent Publication No. 45502/83 (Tokko-sho No. 58-45502) discloses softening methods involving adding lubricant or releasing agent to a fiber base prior to impregnation with a binder, Japanese Patent Publication No. 9315/66 discloses softening methods involving removing one component of a multi-core type composite fiber which constitute a fiber base after binder impregnation. Further, softening methods involving mechanical crumpling are also known. However, these improvement are not satisfactory because a large amount of binder is necessary to keep strength and dimensional stability and the binder causes the artificial leather to exhibit stiffness and rubber-like elasticity. Furthermore, recent fashion trend necessitate more soft, thinner and lighter fabric (even softer than natural leather).

Hitherto applications of the high speed fluid jet treatment to fibrous sheets have been tried. They are: a method for entangling non-woven fabric (U.S. Pat. No. 4,476,186), a method for making an integrated sheet in which textile is interlocked with short fiber (U.S. Pat. Nos. 4,368,227, 4,145,468, 4,146,663). However, these methods are not methods for treating a sheet to which a binder has been applied.

SUMMARY OF THE INVENTION

This invention provides a new method for producing a composite sheet having improved softness, and a new and highly advantageous product. This method does not cause significant decrease of strength and can be applied together with a conventional softening method whilst maintaining both effects independently.

The soft sheet of this invention is a composite sheet which comprises a multiplicity of flexible fibers, initially embedded in a flexible binder to form a sheet, the binder being broken into a multiplicity of small particles many of which are not adhered to each other but are adhered to a multiplicity of the fibers. The invention also provides a method for producing a composite sheet comprising the step of directing a fluid jet stream against and into the binder and penetrate portions of the binder, thereby breaking the binder into a multiplicity of particles not adhered to each other but adhered to the fibers.

The present invention provides a soft synthetic leather in which the binder adheres to the fibers in a fragmentary structure. The binder fragments are dispersed substantially discontinuously and independently from other binder fragments in the sheet.

On the other hand, in conventional artificial leathers, the binder is distributed in a continuous structure.

The nature of the binder structure can be analyzed by dissolving out the fiber component only from a composite sheet. With the composite sheet of this invention, the binder remaining after the fiber component has been dissolved out does not keep its sheet (film-like) structure but is in the form of many small fragments, namely, as separate particles or powder. The amounts and sizes of the small fragments can be determined by filtering, for example with a 10–60 mesh metallic filter. In preferred embodiments of invention, the amount of small fragments having a size of less than 10 mesh is at least 50%, preferably at least 70%.

Figure 1:
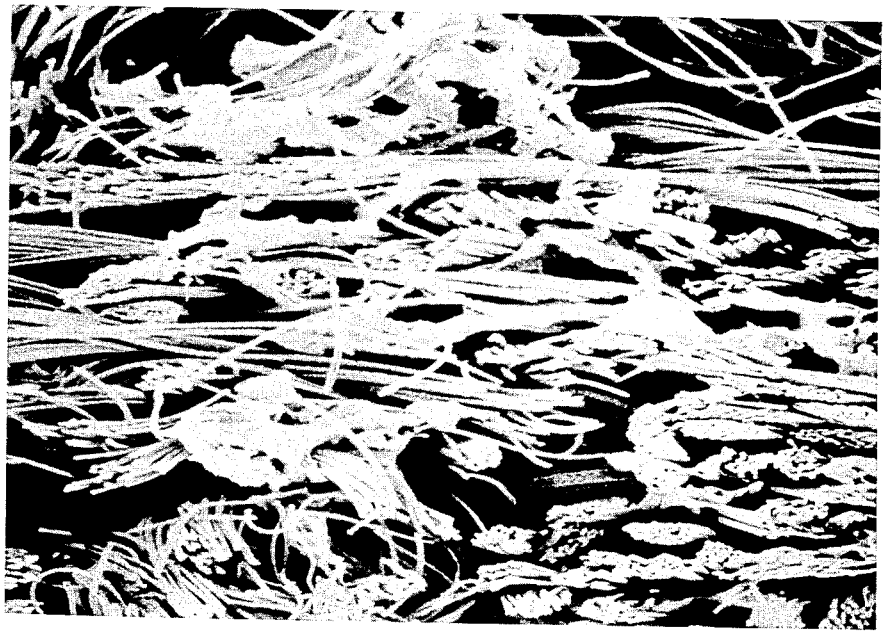
FIGS. 1–3 microphotographs (magnified at 265 times) of cross-section of composite sheet of the present invention in which a typical fragmentary binder structure is shown.
Figure 2:
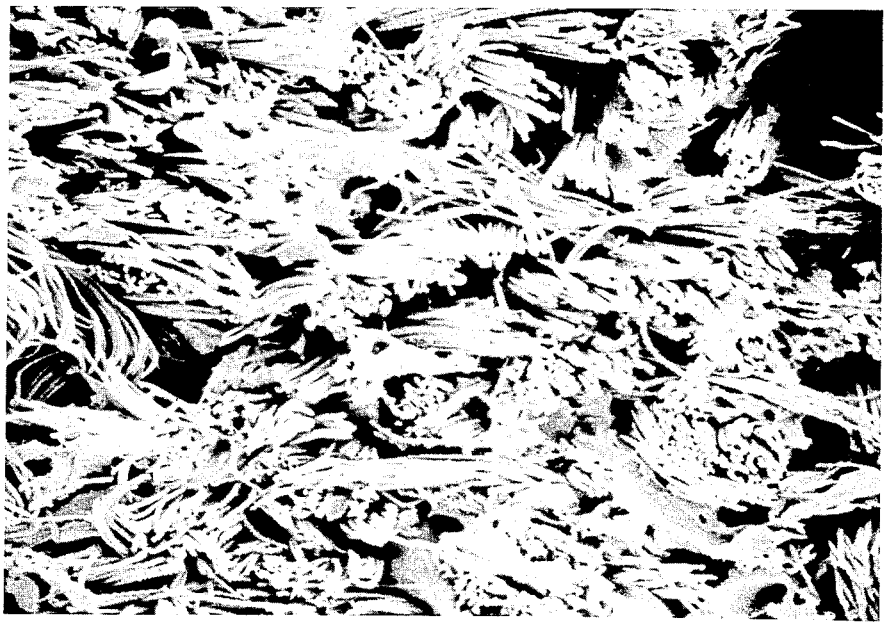
Figure 3:
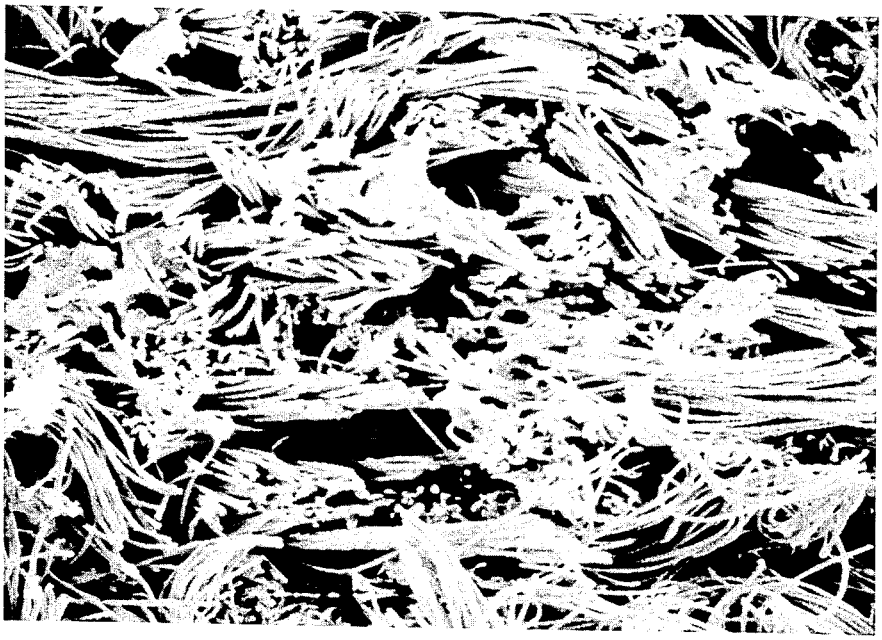
Figure 4:
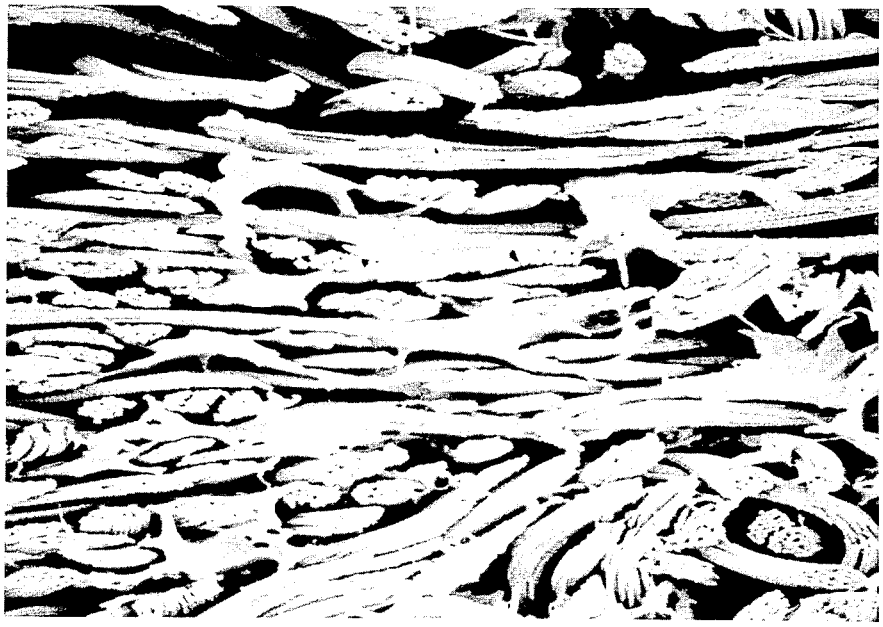
FIG. 4 is a comparative cross-section of a conventional artificial leather in which a continuous binder structure is shown.

The composite sheet of the present invention features the structure as stated, and a variety of preparation methods may be used. Examples are as follows:

DESCRIPTION OF THE PREFERRED EMBODIMENTS

According to this invention the binder is divided into small fragments by physical treatment such as high speed fluid treatment, before, in the course of, or after the binder solution is solidified.

Using such methods, a continuous binder structure in the sheet is fragmented, making the sheet more flexible. By these methods, the binder is caused, at least at and near the surface of the sheet, to remain adhered to the fibers, but in a fragmentary structure; preferably it is adhered fragmentarily to a depth of more than $\frac{1}{4}$ of the thickness of the sheet from the face and/or back. The depth of the fragmentary structure can be predetermined according to the degree of flexibility required. As the required flexibility becomes higher, the fragmentary structure is required to extend deeper inside the sheet. The fragmentary structure may be formed throughout the sheet, by which the sheet can be made highly flexible. When strength is important, it is preferable that at least some continuous binder structure is left in the sheet. In this case, it is preferred for the fragmentary structure to be situated at and near the surface rather than in the interior of the sheet, and a relatively continuous adhesion structure is most preferably provided in the interior of the sheet than. The flexibility of the sheet is influenced more by a fragmentary structure in the interior of the sheet at the surface.

Composite sheets having such a structure may be processed into suede type synthetic leather, grained surface type synthetic leather or base sheets for synthetic furs, which sheets are extremely flexible and have excellent drapability.

Other advantages of the present invention are as follows: since the binder at least in the surface region is divided into small fragments, buffing is easier for making suede type synthetic leathers, and dense crimps and creases can be applied to create grained surface type synthetic leather. In addition, the present invention provides a small decrease in strength relative to a large increase of flexibility.

Fibrous sheets suitable for use in the present invention include, but are not limited to the following: needle punched non-woven fabrics, water jet punched non-woven fabrics, woven or knitted sheets interlocked with short fibers, pile sheets, spun-bonded non-woven fabrics, woven sheets and knitted sheets.

A non-woven fabric is particularly preferred for use in the present invention because it is rather hard due to the thickness and interlocking structure of the fibers.

Fiber components constituting such sheets include, but are not limited to: synthetic fibers such as polyamide (nylon), polyester, polyacrylonitrile, polyethylene, polypropylene, etc., regenerated fibers such as viscose rayon, cupro, etc., semisynthetic fibers such as acetate, etc., and natural fibers such as wool, cotton and hemp. Synthetic fiber is most preferred because it can easily be made very fine; nylon and polyester are most preferable..

Though the sizes of the fibers may be similar to those in general use, a single yarn of the fibers is preferably less than 1 d from the viewpoint of flexibility, most preferably less than 0.3 d.

Microfine fibers may be produced from the following multi-core composite fibers for example: islands-in-sea type fibers having fixed cross-section (Japanese Tokkosho No. 44-18369) or variable cross-section (a blended spun fiber) (Japanese Tokko-sho No. 41-11632); and separable (by peeling mechanically or chemically, for example by swelling at least one component) type fiber (Japanese Tokko-sho No. 39-28005) comprising plural polymers incompatible with each other. Also included are microfine fibers such as acrylic fiber obtained by wet spinning through a sintered metal fiber plate as a spinneret and successive drawing, polyester fiber obtained by the super drawing method and polyester fiber obtained by the melt blowing method.

When islands-in-sea type or separable (by peeling) types of composite fiber are used, the conversion from the composite fiber into microfine fibers may be conducted at any stage of the process. In the present invention, it is most preferable to conduct the conversion before fragmenting the binder.

The fibrous sheet may have any suitable texture weight. Suitable values are between 70 and 500 g/m$^2$ in terms of the weight in the final product.

The fibrous sheet, before the binder is applied may be shrunk or compressed, in order to give a dense feel to the synthetic leather. Water-soluble polymers such as polyvinyl alcohol, carboxymethyl cellulose, etc. may also be applied temporarily to the sheet in order to facilitate the subsequent process or to improve the hand of the final product.

The binders which may be applied to the fibrous sheet include elastomers such as polyurethane, acrylonitrile-butadiene rubber, styrene-butadiene rubber, butyl rubber, neoprene, acryl rubber, silicone rubber, natural rubber, polyamide copolymer, fluorine type elastomers or mixtures thereof. The range of binders which can be selected is wider than in the case of conventional synthetic leather, because the treatment of this invention is able to break up any of these binders to soften the sheet. Thus, it becomes possible to use harder binders which have strong adhesive force. However, polyurethane is most preferred from standpoints such as mechanical strength, hand and practical performance. The binder may be applied in many forms of solution type or dispersion type such as colloid, emulsion and latex, or suspension. A single binder or a mixture of two or more types of binders may be used, and pigments or other additives may be added to the binder.

Methods for applying the binder to the fibrous sheet include conventional method such as impregnation, coating, or spraying.

The amount of the binder applied to the fibrous sheet may be selected according to the type of elastomer and final use of the product. The amount, as solid content, should be 5 to 150%, preferably between 10 to 100%, based on the weight of residual fiber.

The use of a fluid jet, such as water jet punching, ensures that primarily weaker adhesion structures in the sheet are broken and that some strong adhesion structures remain i.e. the fibers and the strongly adhered parts of the binder remain unbroken and the continuous structure of the binder is converted into a fragmentary structure. Consequently, the composite sheet becomes soft while maintaining the strength relatively high.

The fluid is preferably directed uniformly over the sheet so that the effective depth is at least about $\frac{1}{4}$ of the binder-adhering layer. The effective depth is the depth in the sheet up to which the directed fluid causes some structural changes in the size of the binder. When the depth is insufficient, the softening effect decreases.

The fluid jet is usually a high speed fluid jet.

Any fluid may be used, as long as it does not markedly damage or dissolve the fiber or binder. Usually, columnar streams of liquid, preferably water are used, since their effects can reach deep into the composite sheet and they are economical and easy to handle. The fluid may, of course, be admixed with additives in order to prevent pressure loss and improve the injection and penetration effect.

The fluid jet treatment of this invention may be applied in any stage, provided the treatment is conducted after the application of the binder. The treatment can be applied even before completing the solidification of the binder.

In such cases, the entanglement of the fibers or the entanglement of the fibers and the binder can be attained simultaneously with the coagulation of the binder and dividing the binder into fragments, together with an optional removal of a temporarily impregnated binder or a component of the composite fiber. Further, the treatment before completion of solidification causes the composite sheet to be adhered and entangled more densely because the structure of the binder is not fixed at the time of treatment. Thus, a dense and soft composite sheet with relatively high strength can be obtained.

The shape of the injection orifice is not limited in particular, and any shape may be adaptable, although a round shape is used in general. The round orifice preferably has a hole diameter of 0.05 to 3 mm, most preferably 0.1 to 1.0 mm. The injection pressure of the fluid may be adjusted according to the hole diameter of the orifice, distance between the orifice and the structure of the composite sheet to be treated, processing speed, texture weight, thickness and type, amount and adhesion condition of the binder and type of the fluid. The pressure is between 5 and 500 kg/cm$^2$ in general, preferably between 10 and 300 kg/cm$^2$ when the fluid is water. When the injection pressure is too low, the present object cannot be fulfilled, while when too high, the sheet strength decreases. Usually, a row of a plurality of orifices is arranged in widthwise direction of the sheet, and designed to oscillate at least in a widthwise direction. Preferably, the oscillating is performed not only in the widthwise direction but also in the lengthwise direction of the sheet. The angle to the sheet of the high speed fluid may be variable; it is usually 90° ±45° with respect to the sheet surface.

The fluid jet treatment of the sheet may be applied to one or both sides of the sheet. When the sheet is a nonwoven sheet, the treatment may be conducted after the sheet has been sliced into a plurality of sheets.

The softened sheet of this invention may be subjected to buffing followed by dyeing, or further to polyurethane coating if desired. The sheet may be made into an artificial leather such as a suede type or a grained surface type leather which has a soft touch, improved drapability and is elegant in appearance.

The fluid treatment may be applied to the sheet before buffing and/or dyeing. In addition to the effect of giving softness, the treatment can enjoy the benefit of napping by properly adjusting the force or angle of the fluid jets.

The present invention has, among others, the following beneficial effects.

(1) The synthetic leather excellent in softness, drapability and strength are obtained.

(2) It is easy to form naps.

(3) A suede type synthetic leather having naps firmly fixed to the base sheet is obtained.

(4) Solidification with high efficiency and uniformity is achieved.

(5) Dense creases can be applied to create a grained surface type synthetic leather.

(6) The synthetic leather of this invention has deformation recovery properties remarkably similar to those of natural leather. It is easily deformed by stretching in one direction, and recovery is only slow and not complete. But subsequent stretching at 90° to the original stretch direction result in dimensional recovery of the deformation previously experienced in the original direction. The present method is illustrated by the following examples and comparative examples. Measurements of properties were based on the following methods.

Flex rigidity : JIS-L 1079, 5.17
Drape coefficient : method F of JIS-L 1079, 5.17
Strength-elongation test: JIS-L 1079, 5.12.1
Abrasion resistance: Substantially based on ASTM D-1175
Sheafer type abrasion tester
Load; 3628.2 g
Brush; Nylon, 13 mm

EXAMPLE 1 -4 AND COMPARATIVE EXAMPLE 1

A web having a weight of 510 g/m$^2$ was produced by passing an islands-in-sea type composite fiber through a card and cross lapper. The composite fiber consisted of polyethylene terephthalate (PET) as the island component and a copolymer of styrene and 2-ethyl-hexylacrylate (weight ratio: 78/22) as sea component at a weight ratio of 60/40 and having a size of 3.0 denier, 36 islands, a length of 51 mm and 15 to 18 crimp/inch. The web was subjected to needle punching at a needle density of 3000 needles/cm$^2$ and a needle punched sheet having a weight of 525 g/cm$^2$ and apparent an density of 0.212 g/cm$^3$ was obtained. The needle punched sheet was allowed to shrink by passing it through hot water at 80° C. The area shrinkage was 24.1%. The shrunken sheet was impregnated with a 12% aqueous solution of polyvinyl alcohol so that polyvinyl alcohol (PVA) as a solid content was impregnated in an amount of 17.2% based on the fiber base. The sheet was repeatedly dipped and squeezed in trichloroethylene so that the sea component of the composite fiber was removed and the composite fiber was converted into ultrafine fiber bundles. Then, the sheet was repeatedly immersed and squeezed in a 12% polyurethane (PU) solution in dimethylformamide (DMF). Just after that, the sheet was immersed in water at 30° C. for 5 min to partly coagulate the impregnated PU, and then both surfaces of the PU impregnated sheet were subjected to high speed fluid treatment. The high speed fluid treatment was conducted under the following conditions:

Orifice diameter: 0.25 mmϕ
Orifice pitch : 2.5 mm
Oscillating width: 10 mm
Oscillating cycle: 3 times/sec
Treatment speed : 25 cm/min
Water pressure :
25 Kg/cm$^2$ (Example 1)
50 Kg/cm$^2$ (Example 2)
100 Kg/cm$^2$ (Example 3)
150 Kg/cm$^2$ (Example 4)

After treatment each sheet was introduced into water at 30° C. to complete coagulation and was further washed in hot water for the removal of PVA and DMF.

At that time, the amount of PU was 35–40 wt. % based on the weight of the PET fiber. Next the sheet was sliced into halves and both surfaces of each sliced sheet were subjected to a buffing machine to form naps. The buffed sheet was dyed with a disperse dye at 120° C., for 60 minutes using a jet type dying machine and finished. Thus a suede type artificial leather was obtained. As Comparative Example 1, Example 1 was repeated exactly but the water jet process was omitted.

These finished sheet had thicknesses of 0.76, 0.75, 0.82, 0.85 and 0.72 mm, weights of 209, 207, 220, 213, 215 g/m$^2$ and apparent densities of 0.275, 0.276, 0.268, 0.251, 0.299 g/cm$^3$, respectively.

The cross-sections of the composite sheets of Examples 1–3 and Comparative Example 1 are shown in FIGS. 1–4, respectively.

Figure 5:
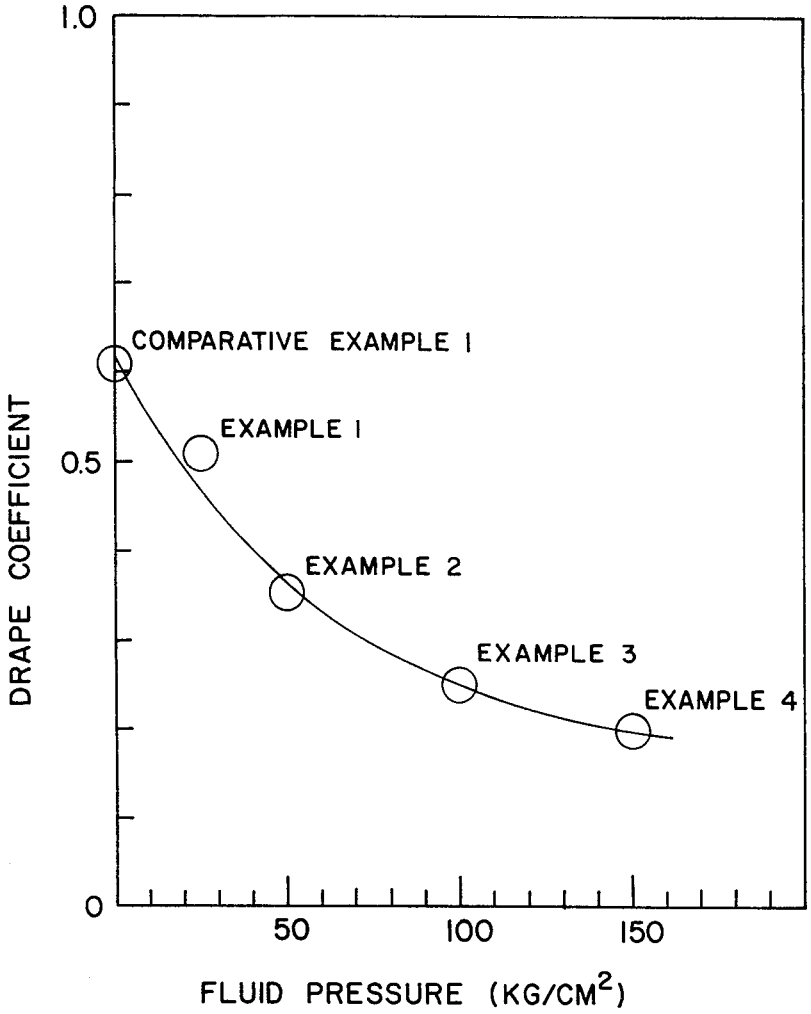
FIG. 5 is a graph which shows the drape coefficient of sheets prepared in accordance with this invention, versus jetting pressure of the water stream used in the process.

The artificial suede of Examples 1–4 were excellent in drapability. The higher the water pressure the larger the effect. On the other hand, the artificial suede of Comparative Example 1 was not soft and had a rather rubber-like elasticity. The fact was shown in FIG. 5.

Each suede was cut into 1 cm×1 cm piece and immersed into sufficient amount of o-chlorophenol (OCP) for 24 hrs at room temperature to dissolve out the PET fiber component selectively leaving the PU undissolved. After the dissolution, by slight shaking, all of the PU of the suedes of Example 2–4 were dispersed as small fragments and no sheet-like structure remained. The PU of the suede of Example 1 remained mostly as relatively large fragments and partly as small fragments, though they were slightly swollen . The PU of the suede of Comparative Example 1 still had substantially the original sheet structure.

Figure 6:
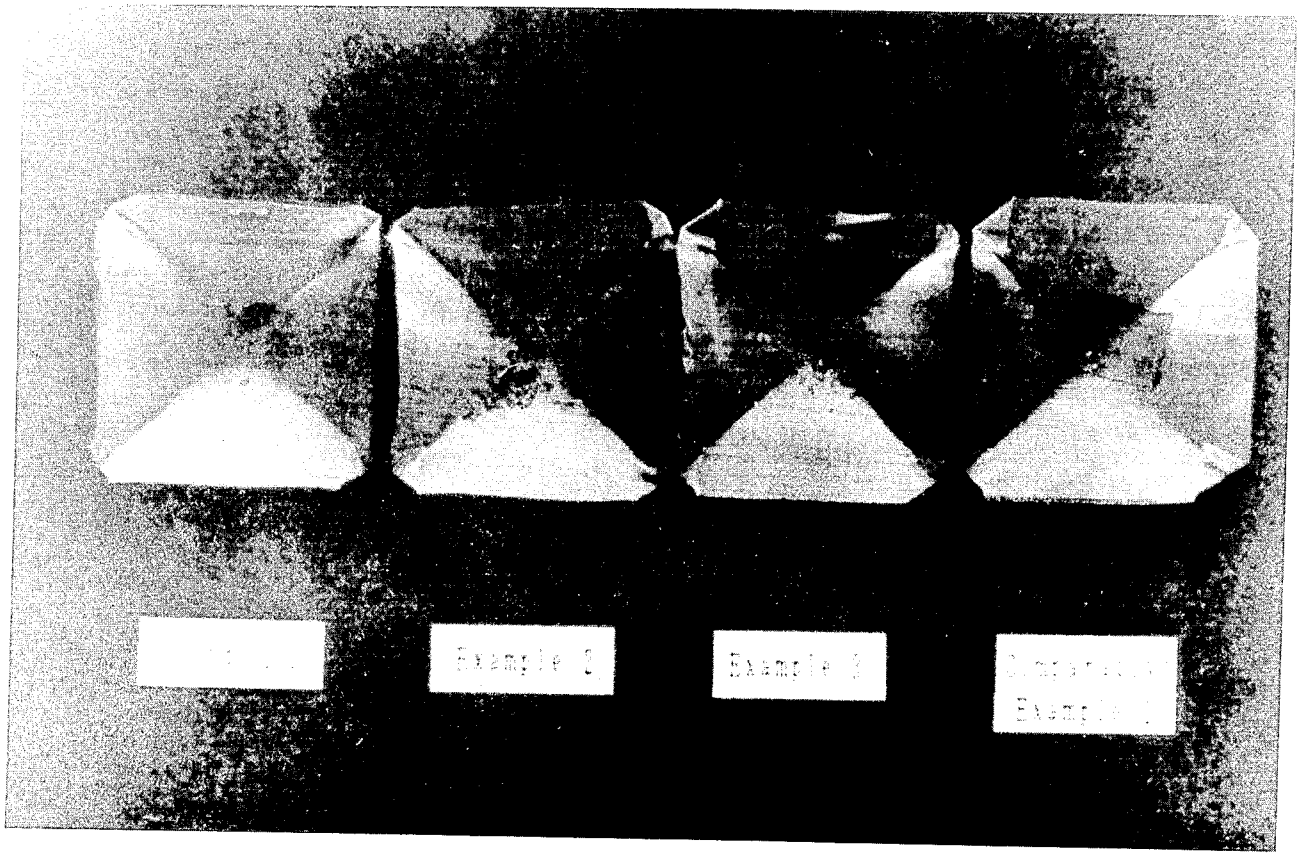
FIG. 6 is a series of photographs of filtered products on their filter screens, and shows binders isolated from the composite sheet from which fragments smaller than 30 mesh were removed.
Figure 7:
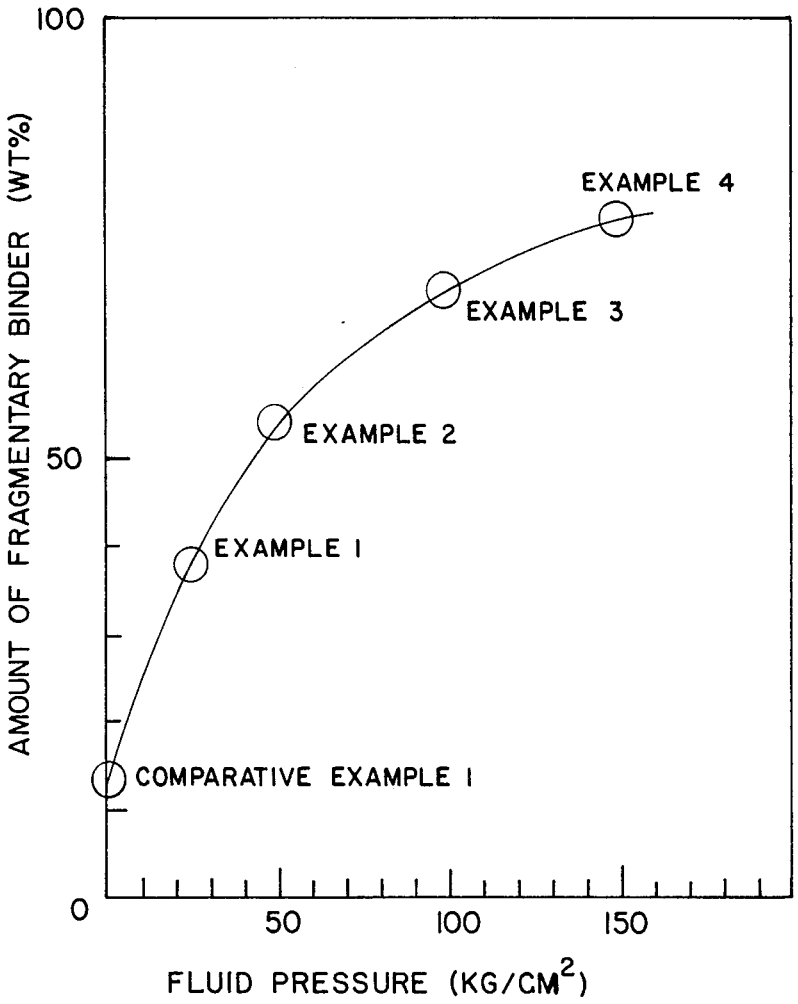
FIG. 7 is a graph which shows the weight ratio of fragmentary binder versus jetting pressure of water stream.

Next, each PU/OCP mixture was filtered with 30 mesh metallic wire-mesh. PU residues were washed with OCP sufficiently and dried. They are shown in FIG. 6. The relation of the amount of PU residue versus water pressure is shown in FIG. 7. FIG. 7 shows that, by the fluid jet treatment, the continuous binder structure of PU can be broken into a fragmentary structure and the fragmentary structure brings about an artificial leather having excellent drapability.

EXAMPLES 5–8, COMPARATIVE EXAMPLES 2–5

Figure 8:
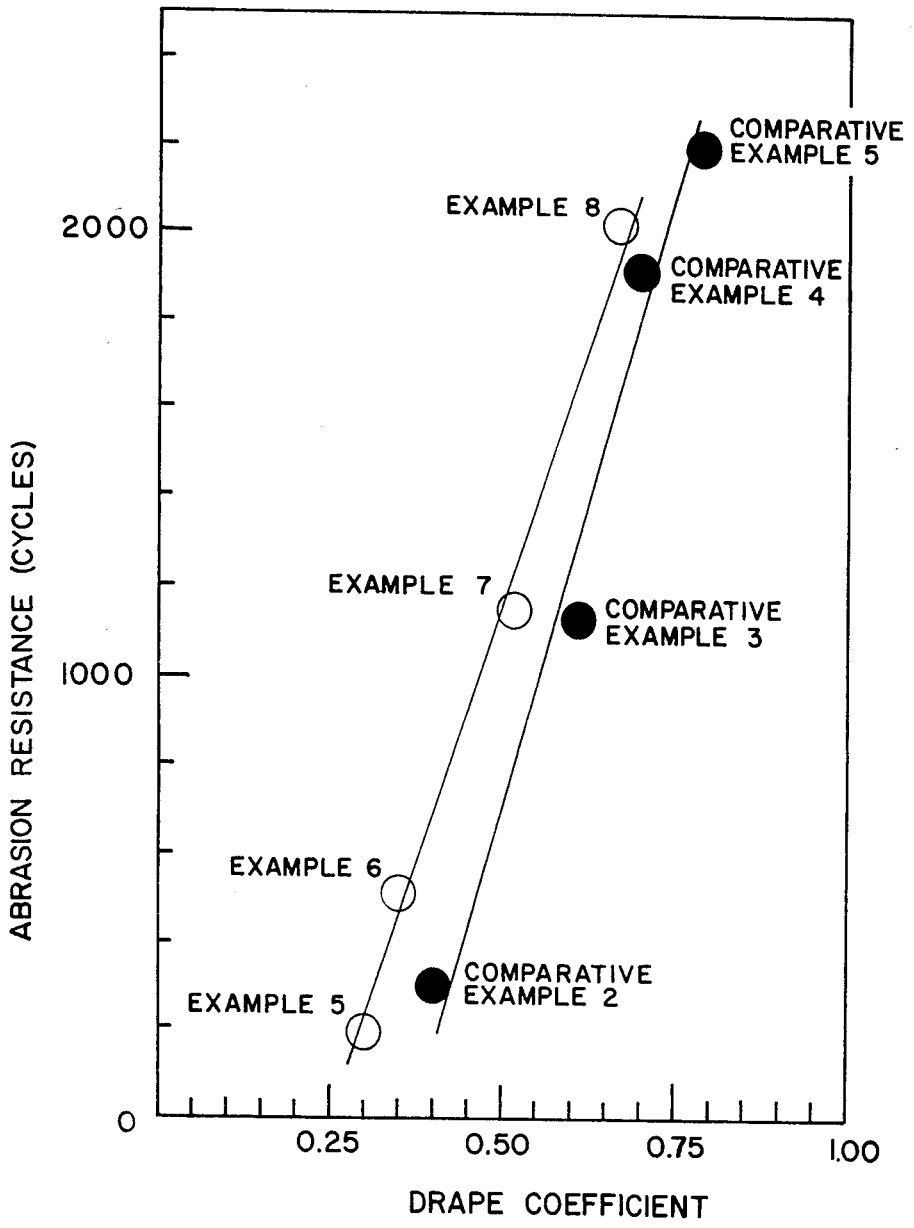
FIG. 8 is a graph which shows the drape coefficient versus abrasion resistance of the artificial leather of the present invention, as compared to that of the prior art.

The sea component removed sheets of Example 1 were impregnated with PU solutions in DMF. The concentrations of PU were 10% (Example 5), 12% (Example 6), 14% (Example 7) and 16% (Example 8). Just after impregnation the sheets were immersed in 30° C. water for 5 minutes to partly coagulate the impregnated PU, then taken out and subjected to water jet treatment on both surfaces. The water pressure was 50 kg/cm$^2$, and all other conditions were the same as Example 1- 4. Comparative Examples 2–5 were also conducted according to Examples 5–8 respectively, but omitting the water jet treatment. After that, the coagulation of PU was completed in 30° C. water, and the PVA and the DMF were removed in hot water. The resulting sheets were sliced into halves and both surfaces of the sliced sheets were buffed to form naps. The buffed sheets were dyed with disperse dye at 120° C., for 60 minutes using a jet dyeing machine. Next the dyed sheets were finished and artificial suede were obtained. The relationship between drape coefficient and abrasion resistance of the resulting artificial suede are shown in FIG. 8. From the results, it is apparent that, by the water jet treatment, a soft and strong composite sheet can be made and that the softening effects are greater than can be attained by only controlling the amount of binder.

EXAMPLE 9, COMPARATIVE EXAMPLE 6

A web was produced through a card and a crosslapper using an islands-in-sea type composite fiber consisting of copolymerized polystyrene with 2-ethyl-hexylacrylate as sea component and polyethyleneterephthalate as island component under the following conditions: islands-in-sea ratio: 50/50; number of islands: 36; denier of the composite fiber: 3 d; fiber length: 51 mm; number of crimps: 15 crimps/inch. A needle-punched sheet of 550 g/m$^2$ was obtained after being subjected to needle punching at a needle density of 3000 needles/cm$^2$. The needle-punched sheet had a weight of 716 g/m$^2$ after being shrunk in hot water at 85° C. The shrunken sheet was impregnated with 10% aqueous PVA solution in an amount of 17.5 wt. % as solid content based on the composite fiber, and after drying, the sea component was removed with trichloroethylene, to convert the composite fiber into microfine fiber bundles. The sheet with the sea component removed was impregnated with 12.5% PU and 1.0% black pigment paste solution in DMF and the PU was solidified in a water bath. The PVA and DMF were removed while the sheet was immersed in hot water and squeezed repeatedly. The amount of polyurethane adhered to the fiber was 40 wt. % based on the weight of PET fiber. The sheet has a weight of 500 g/m$^2$ and thickness of 1.76 mm.

The sheet was subjected to a high speed water jet treatment by passing it once each for both surfaces through a high speed water jet apparatus in which orifices of 0.25 mm diameter were arranged in a straight line at interval of 2.5 mm in the widthwise direction of the process line. Further, in Comparative Example 6, the same treatment as Example 9 was conducted but the high speed water stream treatment was omitted.

The conditions were:

Water pressure
- Condition A: 100 kg/cm$^2$;
- Condition B: 50 kg/cm$^2$

Oscillating width of orifices: 10 mm
Oscillating cycle of orifices: 3 times/sec
Distance between orifice and sheet: 50 mm
Jet angle with respect to sheet surface: 90°
Moving speed of sheet: 25 cm/min The sheet obtained in Example 9, followed by drying, was found to shrink slightly in the lengthwise direction but was of excellent flexibility. In contrast, the sheet obtained in Comparative Example 6 was found to be hard and had a conspicuous rubber-like elasticity.

Next, the sheets were sliced into halves and both surfaces of the sliced sheets were subjected to buffing by a buffing machine provided with a sandpaper of 150 mesh. The resulting sheet was dyed using disperse dye at 120° C. for 50 min and finished through reduction clearing and addition of anti-static agent.

As a result, the sheet obtained in the Example was a leather-like sheet having a high flexibility, good drapability and good hand closely resembling natural suede. In contrast, the sheet obtained in the Comparative Example was a leather-like sheet having a hard hand. The physical properties of the leather-like sheets are shown Table 1.

TABLE 1

| | Example 9 | | |
|---|---|---|---|
| | Water pressure 100 kg/cm$^2$ | Water pressure 50 kg/cm$^2$ | Comparative Example 6 |
| Weight (g/m$^2$) | 215 | 212 | 210 |
| Thickness (mm) | 0.67 | 0.64 | 0.62 |
| Flex Rigidity (mm) | | | |
| Length | 27 | 31 | 46 |
| Width | 25 | 27 | 35 |
| Drape coefficient | 0.25 | 0.29 | 0.40 |
| Tensile strength (kg/cm$^2$) | | | |
| length | 8.1 | 7.4 | 7.5 |
| width | 6.0 | 5.9 | 6.1 |
| Tensile elongation (%) | | | |
| length | 101 | 95 | 86 |
| width | 120 | 122 | 117 |

EXAMPLE 10 AND COMPARATIVE EXAMPLE 7

The needle-punched sheet of Example 1 was shrunk in 80° C. hot water. The area shrinkage was 23.8%. The shrunken sheet was impregnated with a 20% aqueous emulsion of PU as a binder and dried at 100° C. for 20 minutes in a hot flue dryer. The amount of the binder was 25.4 wt. % as solid based on the fiber base. The dried sheet was repeatedly immersed in trichloroethylene and squeezed to remove the sea component and heat treated at 150° C. for 5 minutes. Then both surfaces of the heat treated sheet were treated once each with high pressure water jets of 100 kg/cm$^2$. The other conditions of water jet treatment were substantially the same as Example 1–4. Comparative Example 7 was conducted under the same conditions as Example 10, but the water jet treatment was omitted. The sheets of Example 10 and Comparative Example 7 had weights of 588 and 593 g/m$^2$, thicknesses of 2.35 and 2.28 mm, and apparent densities of 0.250 and 0.260 g/cm$^2$, respectively. Next, the two sheets were sliced into halves and both surfaces of the each sliced sheet were buffed with a buffing machine. Subsequently the buffed sheets were dyed with disperse dye using a jet dying machine and finished. The artificial suede of Example 10 was very soft and covered with dense naps. In contrast, the artificial suede of Comparative Example 7 was hard.

Figure 9:
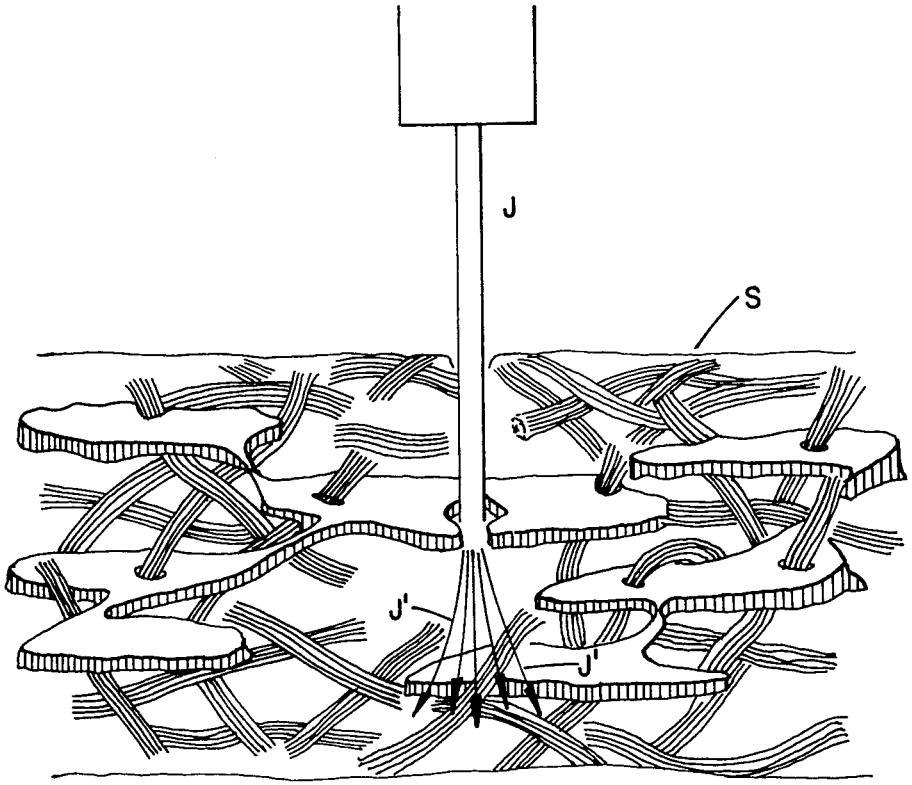
FIG. 9 is a schematic diagram illustrating a penetrating effect as achieved by the jet binder breaking treatment of this invention.

FIG. 9 of the drawings shows schematically an effect achieved by the fluid jet J impinging upon the surface S of the sheet. The jet J is considered to penetrate as a jet into at least a surface portion of the sheet and, while still in the form of a jet, to penetrate through binder particles B, one of which is shown in FIG. 9. At some stage in its passage through the sheet S the jet may disperse as indicated at J', J'.

Repeated penetration and severing of binder particles B, with use of multiple jets and repeated oscillation, effectively reduces the size of the binder particles and produces the remarkable effects heretofore described.

Although this invention has been described with reference to particular forms and embodiments of fibers, binders and jets, these are exemplary and are not intented to define or to limit the scope of the invention, which is defined in the appended claims. For example, heavier denier fibers, or fibers not produced by the islands-in-sea technique, are suitable for some purposes. Other variations may be made, including substitution of equivalent materials and method steps, omission of certain treatments, and reversals of sequence of steps of the method, may be resorted to without departing from the scope of this invention, which is defined in the appended claims.

We claim:

1. A method for producing a composite sheet comprising the steps of (a) adhering a multiplicity of fibers to a binder to form a sheet and (b) directing a fluid jet stream against and into said sheet to break up the binder.

2. A method according to claim 1 wherein at least one surface of said composite sheet is covered with naps.

3. A method according to claim 1, wherein said fibers have an average fineness less than 0.5 denier.

4. A method according to claim 1, wherein said binder is a polyurethane type binder.

5. A method according to claim 1, wherein said fluid is water.

6. A method according to claim 1, wherein said fluid jet stream is applied before completion of the solidification of said impregnated binder.

7. A method according to claim 1, wherein said binder is solidified before said fluid jet stream is applied to the impregnated fiber base.

8. In a method for increasing the softness of a composite sheet, said sheet comprising a multiplicity of flexible fibers dispersed in and adhered to a binder to form said sheet, the step which comprises projecting a fluid jet against and into said sheet and penetrating portions of said binder with said jet, thereby breaking said binder into a multiplicity of pieces not adhered to each other but adhered to said fibers.

* * * * *